US007051914B2

(12) United States Patent
Herelier

(10) Patent No.: US 7,051,914 B2
(45) Date of Patent: May 30, 2006

(54) FASTENING APPARATUS WITH BEARING SHOE AND POSITIONING PLATE

(75) Inventor: Patrick Herelier, Saint Jean de Muzols (FR)

(73) Assignee: Societe de Prospection et d'Inventions Techniques Spit, Bourg-les-Valence (FR)

( * ) Notice: Subject to any disclaimer, the term of this patent is extended or adjusted under 35 U.S.C. 154(b) by 74 days.

(21) Appl. No.: 10/762,554

(22) Filed: Jan. 23, 2004

(65) Prior Publication Data

US 2004/0188493 A1 Sep. 30, 2004

(30) Foreign Application Priority Data

Jan. 23, 2003 (FR) ..... 03 00723

(51) Int. Cl.
*B25C 5/02* (2006.01)

(52) U.S. Cl. ..... 227/110; 227/124; 227/151; 227/111; 227/140

(58) Field of Classification Search ..... 227/130, 227/8, 110, 111, 119, 124, 142, 151, 140
See application file for complete search history.

(56) References Cited

U.S. PATENT DOCUMENTS

| | | | | |
|---|---|---|---|---|
| 2,915,754 | A * | 12/1959 | Wandel | 227/5 |
| 3,107,556 | A * | 10/1963 | Pugsley | 408/110 |
| 3,670,941 | A | 6/1972 | Grinnell | |
| 3,822,817 | A * | 7/1974 | Umphress | 227/110 |
| 4,290,464 | A * | 9/1981 | Marsan | 144/136.95 |
| 4,572,715 | A * | 2/1986 | Wolff | 409/180 |
| 4,655,653 | A * | 4/1987 | Hall et al. | 409/182 |
| 4,729,698 | A * | 3/1988 | Haddon | 408/110 |
| 4,821,938 | A * | 4/1989 | Haytayan | 227/10 |
| 5,054,678 | A * | 10/1991 | Nasiatka | 227/8 |
| 5,150,993 | A * | 9/1992 | Miller | 408/110 |
| 5,165,827 | A * | 11/1992 | Miller | 408/16 |
| 5,261,588 | A | 11/1993 | Lin | |
| 6,631,836 | B1 * | 10/2003 | Dickhaut | 227/148 |

FOREIGN PATENT DOCUMENTS

| | | |
|---|---|---|
| DE | 94 020 286 U | 3/1995 |
| FR | 2 383 755 | 10/1978 |
| GB | 2 375 075 A | 11/2002 |

* cited by examiner

*Primary Examiner*—Scott A. Smith
*Assistant Examiner*—Brian Nash
(74) *Attorney, Agent, or Firm*—Lowe Hauptman & Berner, LLP

(57) ABSTRACT

The apparatus is intended to drive fasteners (21) for fastening a piece (20) to a support (30). The apparatus has a snout (12) equipped with a bearing shoe (14). The shoe is equipped with lateral positioning one-piece plate (15) on which there are formed a number of distinct lateral bearing surfaces (8, 8', 8", 8 82, 83) roughly parallel to the axis of the snout to be applied in particular to an edge of one of the pieces either the support piece or the piece that is to be fastened.

18 Claims, 2 Drawing Sheets

FASTENING APPARATUS WITH BEARING SHOE AND POSITIONING PLATE

FIELD OF THE INVENTION

The invention relates to pneumatically-, gas- or powder-driven fastening apparatuses used in building work for driving fasteners and thus fastening a piece that is to be fastened onto a support piece. More particularly, the invention relates to staple guns with which, for example, cladding panels can be fastened.

It is increasingly frequent for this type of fastening to need to be performed precisely on the support and with a given length of penetration.

For that, the snouts of current fastening apparatuses are generally equipped with a bearing shoe used also for adjusting the axial penetration and the position of which can be adjusted parallel to the axis of the snout to allow the apparatus to be applied to the piece that is to be fastened via a bearing surface situated on one of its ends. However, while the fastening is thus made precise in terms of axial penetration of the fasteners, it remains imprecise in terms of the lateral position in a plane perpendicular to the axis of the snout.

Now, when the issue is one of fastening pieces via their edges onto supports which may in addition be of small surface area: beams, joists or other supports commonly used in building work, this position cannot remain approximate. This forces the workers using this type of apparatus to take greater care in their fastening work, and this leads to a loss of time.

BACKGROUND OF THE INVENTION

Document U.S. Pat. No. 3,670,941 discloses a fastening apparatus of the type introduced hereinabove, comprising lateral positioning means, but with only one possible spacing.

Document FR 2 383 755 also discloses such an apparatus, with a lateral positioning screw which demands extremely fine adjustment.

BRIEF DESCRIPTION OF THE INVENTION

The applicant company has set itself the task of proposing a fastening apparatus of the kind, introduced hereinabove, that is more flexible and easier to use.

Thus, the applicant company proposes a fastening apparatus of the above type comprising a snout equipped with a bearing shoe for adjusting the axial penetration of the fasteners along the axis of the snout, characterized in. that the said shoe is equipped with a lateral positioning one-piece plate on . . . which there are formed a number of distinct lateral bearing surfaces roughly parallel to the axis of the snout for being applied in 'particular to an edge of one of the pieces, either the support piece or the piece that is to be fastened.

Thus, the bearing surfaces of the shoe and of the positioning plate forms square parts with which the plate that is to be fastened is positioned laterally and precisely without a loss of time.

As the lateral positioning plate is mounted on the shoe, the penetration can be adjusted without altering the lateral position adjustment, and vice versa.

As a preference, the lateral bearing surfaces of the positioning plate are formed at different distances from the axis of the snout and can be used independently of one another according to the positioning of the plate on the shoe.

Advantageously, the lateral bearing surfaces of the plate are circularly distributed on the lateral positioning plate and the plate is mounted so that it can turn and is held in place 'under the action of the return means.

Advantageously too, the lateral positioning plate is fixed to the shoe by indexing on the bearing position of the bearing surfaces of the plate, and, as a preference, the indexing is achieved by clicking.

Advantageously still, the plate is designed to be able to be mounted turned over on itself on the shoe, which doubles the number of bearing surfaces that can be used per positioning plate.

In an advantageous embodiment of the apparatus of the invention, at least one stud is provided that functionally widens the lateral positioning plate.

BRIEF DESCRIPTION OF THE DRAWING

The invention will be better understood with the aid of the following description, and of the accompanying drawing which.

DETAILED DESCRIPTION OF THE INVENTION

Figure 1:
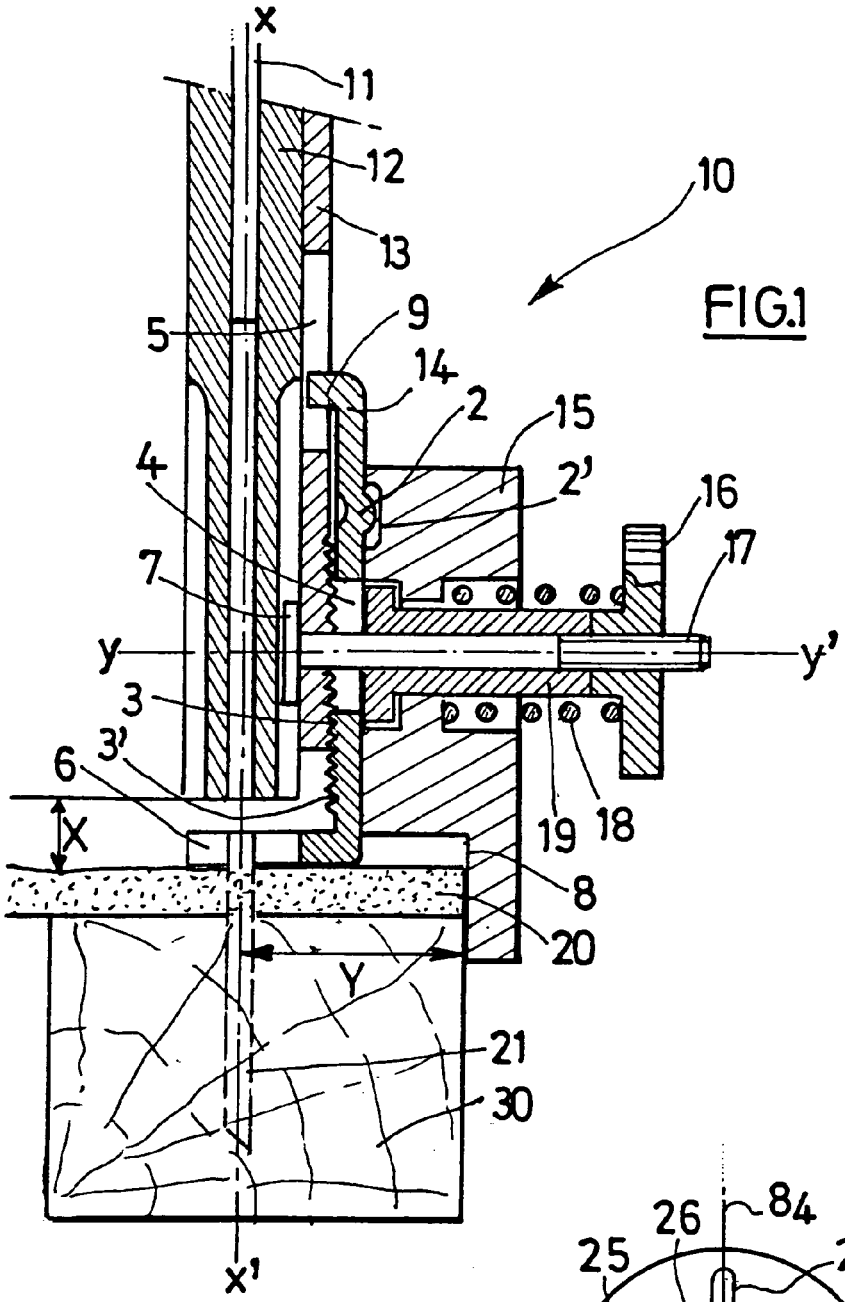
FIG. 1 depicts an axial section through the fastening apparatus according to the invention.

With reference to FIG. 1, the fastening apparatus 10 is made up of a snout 12 of axis xx' in which there slides a piston 11 moved, for example, under the action of the pressure of a gas from a compressor, not depicted, to cause a fastener 21, for example a nail or a piton, from a supply magazine, also not depicted, to penetrate axially into the piece 20 that is to be fastened to a support 30. The snout supports an arming slideway 13 which is secured to it and which has a striated region 3 in which a striated region 3' of a safety bearing shoe 14 can sit according to the positions for adjustment of the axial penetration of the fastener 21.

For this, the shoe 14 has a bearing surface 6 perpendicular to the axis xx' to keep the end of the snout 12 a set distance X away from the piece that is to be fastened.

The set distance X. of the penetration is obtained by sliding the sloe along the slideway parallel to the axis xx' by virtue of the holding afforded by a stud 9 of the shoe in a slot 5 of the slideway.

When the adjustment is obtained, the slideway 13 is clamped against the shoe 14 between the head 7 of a screw 17 of axis yy' perpendicular to the axis xx' and a nut 16 as the adjusting nut.

The striated regions 3 and 3' nestle together and this secures the shoe and the slideway.

A slot 4 allows the screw 17 to pass through the shoe.

Here, a lateral positioning one-piece plate 15 designed to turn about the screw 17 and to be locked in its indexed positions i explained hereinafter, for which the plate, in the case of each one, presents a bearing surface 8 roughly parallel to the axis xx', a distance Y from this axis, is inserted between the shoe and the adjusting nut.

Also inserted, in order to compensate for the thickness of the plate 15, is a ring 19, slipped freely over the screw, between the shoe and the nut. This ring which acts as a stop, allows the plate to rotate about the screw, merely under the pressure of a return spring 18 compressed onto the said plate by the adjusting nut.

Figure 2:
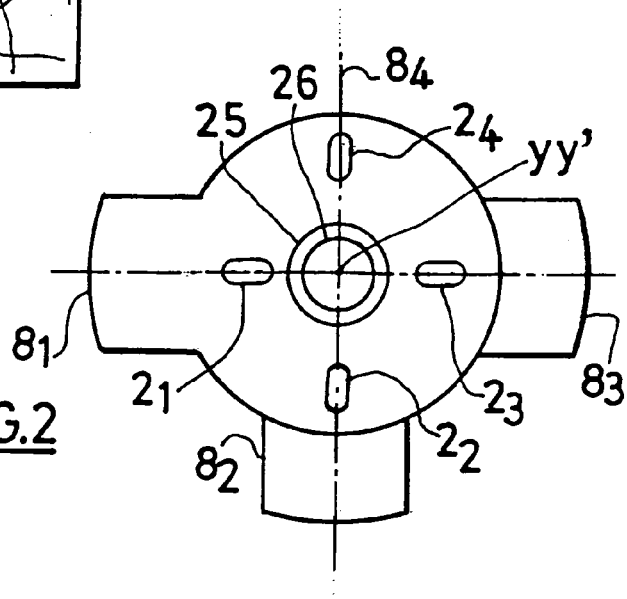
FIG. 2 depicts a plan view of the positioning plate, FIG. 3 depict sectional views of various possible bearing surfaces in the indexed position.

With reference to FIG. 2, which depicts the plate 15 in plan view, the indexed positions i of the bearing surfaces 8, labeled 8*i*, in this instance $\mathbf{8}_1$ $\mathbf{8}_2$, $\mathbf{8}_3$, and a position 84 of absence of bearing surface are embodied by recesses, preferably, as here, oblong recesses, formed on the shoe on the bearing face, labeled $\mathbf{2}_1$, $\mathbf{2}_2$, $\mathbf{2}_3$, $\mathbf{2}_4$ and uniformly circularly distributed about the axis yy' of the screw 17 or of the ring. 19 which pass through the plate at a hole 26. The positions are obtained in succession by turning the plate in such a way as to set a boss 2 provided on the shoe in one of the recesses, $\mathbf{2}_1$, $\mathbf{2}_2$, $\mathbf{2}_3$ or $\mathbf{2}_4$, which bossy is held there by clicking under the action of the spring 18.

The bearing surfaces 8 82, 83 give different lateral distances $Y_1$, $Y_2$, $Y_3$ between the edge of the piece 20 that is to be fastened or of the support piece 30 and the axis xx' of the axial penetration of the fastener.

Furthermore, a bore 25 houses the end of the spring 18.

Figure 3:
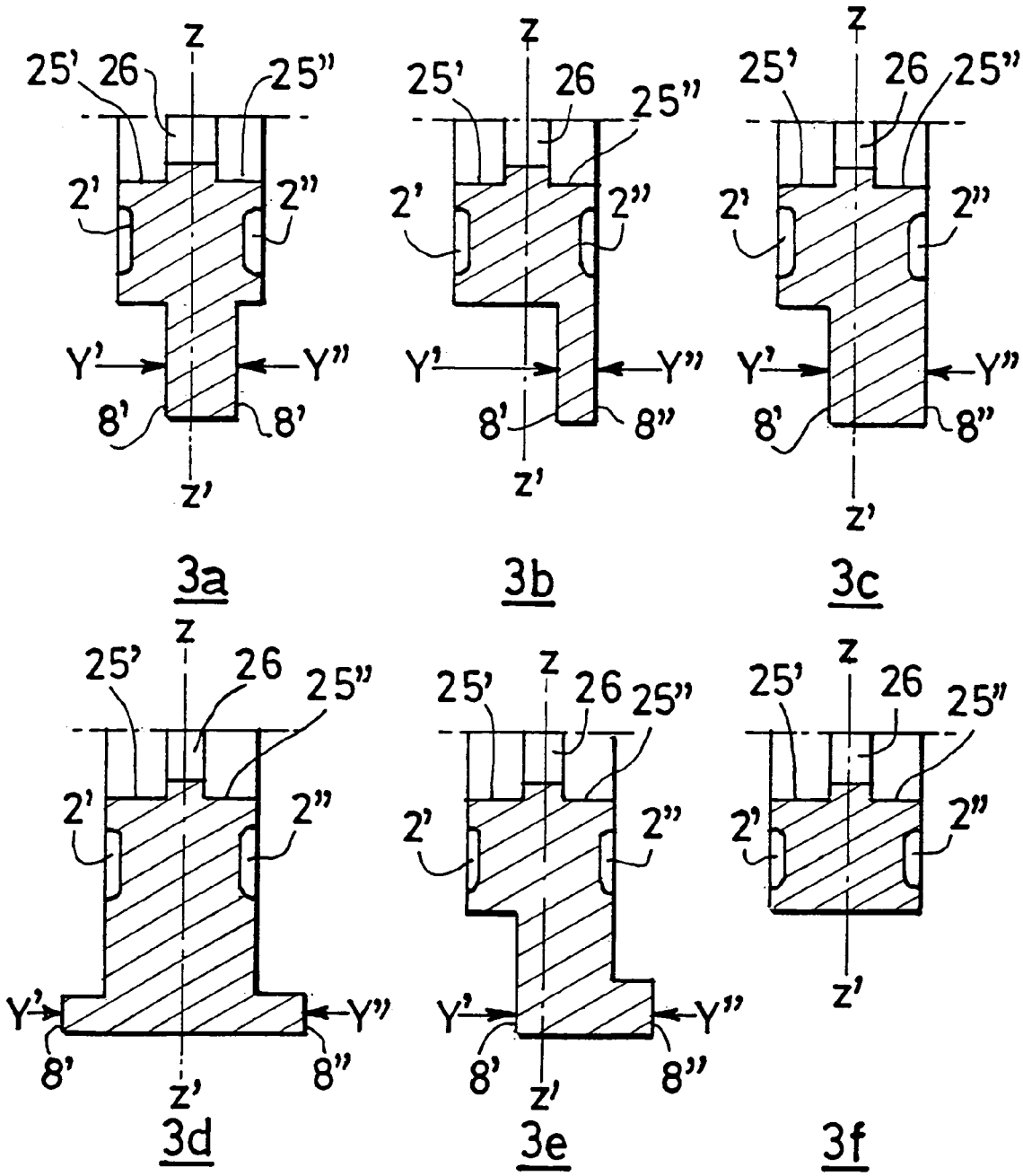

With reference to FIG. 3, those labeled 3*a* to 3*e*, to each indexing recess 2' on a bearing face 8' of the plate there corresponds symmetrically a recess 2" and a bearing face 8" on the opposite face is of the plate, and to the bearing surface 8' that allows the fastening to be performed at a lateral distance Y' from the edge of the piece that is to be fastened there corresponds the bearing surface 8" that allows this fastening to be performed at a lateral distance Y" different from Y'.

Finally, as shown in FIG. 3*a*, a symmetric bore 25", for housing the end of the spring 18, corresponds to the bore 25'.

Through these arrangements, the plate is designed to be mounted turned over on itself and is therefore reversible on the shoe so that it can be used on both faces.

FIGS. 3*a*, 3*b*, 3*c*, 3*d*, 3*e* thus show various possible settings for lateral distances Y offered by the various bearing surfaces of a positioning plate, turned over or otherwise.

In particular, FIGS. 3*d* and 3*e* show an advantageous embodiment of positioning plates, in which one of the bearing surfaces 8' or 8", or both in FIG. 3*d*, consist of a stud (8' or 8") that functionally widens the plate, allowing a reduction in the distance Y which can thus be shorter than the thickness of the apparatus consisting of the snout and shoe assembly.

Finally, FIG. 3*f* shows the configuration of the plate of FIG. 2 in half section on a plane passing through the axis yy' and the recess 24 for which there is no bearing surface.

The fastening apparatus is adjusted in terms of axial and lateral position by performing the following operations:

the adjusting nut 16 is slackened, the shoe 14 is slid along the arming slideway 13 to a position X corresponding to the desired axial penetration of the fastener 21, the nut 16 is tightened onto the ring 19 to cause the striated regions 3, 3' to nestle together and thus fix the shoe on the slideway, the plate 15 is turned about the screw 17 to bring into position the bearing surface 8 that gives the desired lateral distance Y. The position is reached when the boss 2 is clicked into one of the recesses $\mathbf{2}_1$, $\mathbf{2}_2$, $\mathbf{2}_3$ or $\mathbf{2}_4$ corresponding to the bearing surface laterally distant from the axis xx' of the snout of the apparatus by $Y_1$, $Y_2$, $Y_3$ or $Y_4$.

To turn the plate 15 over, the adjusting nut 16 is slackened, the plate is removed from the ring 19 and, the spring 18 being disengaged from the bore 25', the plate is put back in place the other way up on the ring 19, the spring 18 is engaged in the bore 25" sym metric with the bore 25', and the adjusting nut 16 is tightened again.

The invention claimed is:

1. A fastening apparatus, comprising: a muzzle; a piston slidable within and along an axis of the muzzle for driving fasteners out of the muzzle; a lateral positioning member having a plurality of different, lateral bearing surfaces and being moveable relative to said muzzle so as to bring any of the different, lateral bearing surfaces to a reference position in which said lateral bearing surfaces are spaced from the axis of said muzzle by different distances, respectively, and in which said lateral bearing surfaces are placeable against a side of a workpiece, to whereby allow positioning of said muzzle at said different distances from the side of the workpiece; and wherein said lateral positioning member is rotatably attached to said muzzle.

2. The fastening apparatus of claim 1, wherein a rotational axis of said lateral positioning member is perpendicular to the axis of said muzzle.

3. The fastening apparatus of claim 1, wherein said lateral positioning member comprises a plate and a plurality of projections extending outwardly from said plate in different radial directions of said plate, each of said projections defining at least one of said lateral bearing surfaces.

4. The fastening apparatus of claim 3, wherein said lateral positioning member further comprises at least a protrusion extending in an axial direction of said plate from an end portion of one of said projections and defining one of said lateral bearing surfaces.

5. The fastening apparatus of claim 3, wherein said projections are mutually different in at least one of their configurations and their placements along an axial direction of said plate.

6. The fastening apparatus of claim 3, wherein said lateral positioning member further comprises a plurality of locking elements arranged circumferentially on said plate, each of said projections corresponding to one of said locking elements which are engageable with a matching locking member on an outer wall of said muzzle for releasably locking said lateral positioning member and said muzzle at any of a plurality of different relative positions, respectively, each of said relative positions corresponding to one of said lateral bearing surfaces being placed in the reference position.

7. The fastening apparatus of claim 6, wherein said locking elements are recesses.

8. The fastening apparatus of claim 7, wherein said recesses are provided on opposite end surfaces of said plate.

9. The fastening apparatus of claim 1, further comprising a plurality of different locking elements for releasably locking said lateral positioning member and said muzzle at any of a plurality of different relative positions, respectively, each of said relative positions corresponding to one of said different locking elements and one of lateral bearing surfaces being placed in the reference position.

10. A fastening apparatus, comprising:

a muzzle;

a piston slidable within and along an axis of the muzzle for driving fasteners out of an end of the muzzle;

an axial positioning member for adjusting a first distance from the end of the muzzle to a first surface of a workpiece;

a lateral positioning member for adjusting a second distance from the end of the muzzle to a second surface of the workpiece;

a common, elongated fastening element that attaches both said axial positioning member and said lateral positioning member to said muzzle; and wherein said lateral positioning member is moveably attached by said elongated fastening element to said muzzle, whereas said axial positioning member is immoveably fixed by said elongated fastening element to said muzzle.

11. The fastening apparatus of claim 10, wherein said axial positioning member comprising a grooved surface engaged with a matching grooved surface of said muzzle.

12. The fastening apparatus of claim 10, wherein said lateral positioning member is rotatably attached by said elongated fastening element to said muzzle.

13. The fastening apparatus of claim 10, wherein said lateral positioning member has a plurality of different, lateral bearing surfaces which are placeable, by a rotation of said lateral positioning member, in a reference position in which said different, lateral bearing surfaces are spaced from the axis of said muzzle by different distances, respectively.

14. A fastening apparatus, comprising:

a muzzle;

a piston slidable within and along an axis of the muzzle for driving fasteners forwardly from an end of the muzzle;

an axial positioning member having an axial beating surface positioned forward of the end of the muzzle, said axial positioning member being fixable to said muzzle at various locations for adjusting a first axial distance between said axial bearing surface and the end of said muzzle; and a lateral positioning member having a plurality of different, lateral bearing surfaces and being rotatably attached to said muzzle, wherein said different, lateral bearing surfaces are placeable, by a rotation of said lateral positioning member, in a reference position in which said different, lateral bearing surfaces are forward of the end of said muzzle and spaced from an axis of said muzzle by different distances, respectively.

15. The fastening apparatus of claim 14, further comprising a bolt having a head at an end thereof and extending through a first hole in said lateral positioning member to define a rotational axis of said lateral positioning member;

a nut threaded onto an opposite end of said bolt; and a spring disposed together with said lateral positioning member between said nut and the head of said bolt;

wherein said lateral positioning member is rotatably attached to said muzzle by said bolt, nut and spring while remaining moveable along the bolt upon elastic deformation of said spring.

16. The fastening apparatus of claim 15, wherein said axial positioning member comprises:

a first section positioned forward of said end of said muzzle and having said bearing surface;

a second section extending from said first section rearwardly and along said muzzle, said second section comprising a grooved surface engaged with a matching grooved, outer surface of said muzzle, and a second hole through which said bolt extends to whereby fix said axial positioning member to said muzzle by said bolt and nut.

17. The fastening apparatus of claim 16, wherein said lateral positioning member comprises a plurality of different locking elements arranged circumferentially about the first hole, each of said locking elements corresponding to one of said lateral bearing surfaces;

said second section of said axial positioning member comprises a matching locking member engageable with any of said locking element of the lateral positioning member to whereby releasably lock any of the lateral bearing surfaces in the reference position when the corresponding locking element is engaged with said locking member.

18. The fastening apparatus of claim 17, further comprising a spacer having a first end abutting said second section of said axial positioning member and a second end abutting said nut, so as to rigidly press the grooved surfaces against each other when said nut is fastened and allow disengagement of said grooved surfaces and axial movement of the axial positioning member along said muzzle when said nut is loosened.

* * * * *